US010032444B2

(12) United States Patent
Jambrosic et al.

(10) Patent No.: US 10,032,444 B2
(45) Date of Patent: Jul. 24, 2018

(54) RESONATOR ABSORBER WITH ADJUSTABLE ACOUSTIC CHARACTERISTICS

(71) Applicant: SVEUCILISTE U ZAGREBU FAKULTET ELEKTROTEHNIKE I RACUNARSTVA, Zagreb (HR)

(72) Inventors: Kristian Jambrosic, Zagreb (HR); Ivan Vican, Imotski (HR); Hrvoje Domitrovic, Zagreb (HR)

(73) Assignee: SVEUCILISTE U ZAGREBU FAKULTET ELEKTROTEHNIKE I RACUNARSTVA, Zagreb (HR)

( * ) Notice: Subject to any disclaimer, the term of this patent is extended or adjusted under 35 U.S.C. 154(b) by 0 days.

(21) Appl. No.: 15/736,071

(22) PCT Filed: Jun. 18, 2015

(86) PCT No.: PCT/HR2015/000013

§ 371 (c)(1),
(2) Date: Dec. 13, 2017

(87) PCT Pub. No.: WO2016/203278

PCT Pub. Date: Dec. 22, 2016

(65) Prior Publication Data

US 2018/0174567 A1 Jun. 21, 2018

(51) Int. Cl.
*G10K 11/168* (2006.01)
*E04B 1/99* (2006.01)

(52) U.S. Cl.
CPC ..... *G10K 11/168* (2013.01); *E04B 1/994* (2013.01)

(58) Field of Classification Search
CPC ..... G10K 11/168; E04B 1/994
(Continued)

(56) References Cited

U.S. PATENT DOCUMENTS 1,975,604 A 10/1934 Hanson
4,122,915 A 10/1978 Taguchi
(Continued)

FOREIGN PATENT DOCUMENTS

AT 413901 B 7/2006
FR 2630469 A1 10/1989
FR 3014236 A1 6/2015

OTHER PUBLICATIONS

Varitune V-4 [back], http://www.diffusor.com/English/Varitune/v4.htm, 1 page.

(Continued)

*Primary Examiner* — Forrest M Phillips
(74) *Attorney, Agent, or Firm* — RatnerPrestia

(57) ABSTRACT

A resonator absorber with adjustable acoustic characteristics made in the form of a cuboid with sidewalls and with an open upper face that is covered by two identical movable perforated plates to allow partial overlapping of the the plates. Each plate is equipped with bores forming a planar binary amplitude diffusor by using a maximum length pseudorandom binary sequence mapped to 2D space to determine the bore position. Bores are arranged in rows which do not overlap between plates. The resonator absorber has six cavities of different geometry situated below the perforated plates, where five cavities simultaneously change the volume with movement of the perforated plates. The resonator absorber is useful for tuning the acoustic characteristics of the environment.

10 Claims, 8 Drawing Sheets

(58) Field of Classification Search
USPC ..... 181/286, 284, 290
See application file for complete search history.

(56) References Cited

U.S. PATENT DOCUMENTS

| | | | | |
|---|---|---|---|---|
| 4,821,839 | A | 4/1989 | D'Antonio et al. | |
| 5,817,992 | A | 10/1998 | D'Antonio | |
| 6,112,852 | A | 9/2000 | D'Antonio et al. | |
| 7,428,948 | B2 | 9/2008 | D'Antonio et al. | |
| 7,520,370 | B2 | 4/2009 | Gudim | |
| 8,424,637 | B2 | 4/2013 | Lenz, Jr. | |
| 8,567,558 | B2 * | 10/2013 | Nakajima | E04B 1/86 181/210 |
| 8,573,357 | B1 * | 11/2013 | Hibbs | E06B 5/20 181/287 |
| 8,733,500 | B1 * | 5/2014 | Ayle | G10K 11/172 181/292 |
| 9,145,675 | B2 * | 9/2015 | Gimbel | E04B 1/994 |
| 2003/0006092 | A1 | 1/2003 | D'Antonio et al. | |
| 2005/0173187 | A1 | 8/2005 | Gardner et al. | |
| 2006/0042875 | A1 | 3/2006 | Zainea | |
| 2007/0186493 | A1 * | 8/2007 | Baig | B28B 11/12 52/144 |
| 2008/0128202 | A1 * | 6/2008 | Palumbo | B32B 3/12 181/292 |
| 2012/0156006 | A1 * | 6/2012 | Murray | F02C 7/045 415/119 |
| 2014/0233781 | A1 * | 8/2014 | Kawakami | D04H 1/46 381/359 |
| 2015/0243274 | A1 * | 8/2015 | Hirakawa | G03G 21/00 399/91 |
| 2016/0071507 | A1 * | 3/2016 | Kim | G10K 11/172 181/286 |
| 2016/0185442 | A1 * | 6/2016 | Chin | B64C 1/40 244/133 |

OTHER PUBLICATIONS

Vican et al., Comparison of acoustic resistance of a perforated plate absorber with a tightly and loosely placed thin porous layer, 6th Congress of Alps-Adria Acoustics Association, Oct. 16-17, 2014, Graz, Austria, 7 pages.

Ingard, On the Theory and Design of Acoustic Resonators, The Journal of the Acoustical Society of America, vol. 25, No. 6, Nov. 1953, pp. 1037-1061.

Angus et al., Two Dimensional Binary Amplitude Diffusers, 107th AES Convention, New York, Sep. 24-27, 1999, 15 pages.

International Search Report issued in PCT/HR2015/000013 dated Feb. 12, 2016, 4 pages.

Written Opinion of the International Searching Authority issued in PCT/HR2015/000013 dated Feb. 12, 2016, 5 pages.

* cited by examiner

RESONATOR ABSORBER WITH ADJUSTABLE ACOUSTIC CHARACTERISTICS

CROSS REFERENCE TO RELATED APPLICATIONS

This application is the U.S. National Phase Application of PCT/HR2015/000013, filed Jun. 18, 2015. The contents of such application being incorporated by reference herein.

TECHNICAL FIELD

The present invention discloses resonator absorber with adjustable acoustic characteristics. Disclosed resonator absorber, formed as a standalone element, is useful for tuning the acoustic characteristics of environment with mechanically adjustable reflective, diffusive and absorptive parts. Therefore, the technical field is related to the elements capable of tuning the acoustic characteristics of environment.

Technical Problem

Various criteria exist for assessing the quality of the sound heard by a listener listening to the sound emitted by sound sources into the listening environment. The sound emission can be performed directly from various sound sources, or via an amplified, previously electronically recorded acoustical signal. The common technical problem is how the acoustical signal should be faithfully and accurately acoustically reproduced at the position of the listener, or group of listeners within a certain area.

In order to achieve this, the listening environment must not exhibit acoustical qualities that unduly mask, distort, or confuse the reception of the acoustic signal by the listener. Another of these criteria is that the quality of the sound heard by a listener should be subjectively pleasing to that listener. Said acoustic quality of an environment is largely defined by diffusive, absorptive and reflective properties of its bordering surfaces.

Acoustic elements for tuning the acoustic characteristics of environment already present in the art are mainly focused to modify either diffusive or absorptive characteristics of the reflecting surfaces that are reached by the sound waves. Only few technical solutions can change their acoustical properties but none of them in a simple and reliable manner.

A technical problem addressed with an aspect of the present invention is how to develop a resonator absorber with adjustable acoustic characteristics capable of being adjusted in a simple and reliable manner. It is known in the art that only one type of acoustic element is usually insufficient for tuning the acoustic characteristics of environment. The plurality of disclosed resonator absorbers with different geometrical properties can be combined together simultaneously; each resonator absorbers with arbitrary adjustable acoustic characteristics, for tuning the acoustic characteristics of environment. Considering the fact that it is necessary to tune up an array of disclosed resonator absorbers shows again the importance of its simple and reliable tuning.

Simple and reliable tuning of the disclosed resonator absorber with adjustable acoustic characteristics is achieved by the combination of two movable planar binary amplitude diffusors that can overlap each other over a series of cavities having different volumes and acting as a series of Helmholtz resonators.

Previous State of Art

Previous state of art is rather crowded with the technical solutions regarding the elements used for tuning the acoustic characteristics of environment.

Document U.S. Pat. No. 1,975,604; inventor is Hanson O.B., which is incorporated by reference, discloses the adjustable acoustic element where various movable elements in form of planes can partially or entirely cover the walls equipped with shallow recesses in order to tune up the acoustic characteristics of environment. This early solution remains silent regarding the characteristic of the movable elements, possible use of the Helmholtz resonators or planar binary amplitude diffusors.

Document FR 2 630 469; inventor is Val M., which is incorporated by reference, discloses the self-supporting structure intended for making noise-insulating and absorbing screens, with variable acoustic characteristic. The series of concave elements, e.g. reflectors, are equipped with the rotational absorbers where each rotational absorber should be adjusted independently, situated in focus of said reflectors. The similarity with the present invention consist in that the cited solution represents tunable self-supporting structure.

Document U.S. Pat. No. 4,122,915; inventor is Taguchi, K., which is incorporated by reference, teaches about sound absorbing and diffusing unit, formed as an acoustic screen and/or a partition. The cited prior art discloses the unit where it is possible to regulate absorptive and diffusive characteristics of the said unit by independent rotation of each element forming the said unit. The similarity with the present invention consist in that the cited solution is tunable and possibly self-supporting.

Document U.S. Pat. No. 4,821,839; inventors are D'Antonio P. and Konnert J. H., which is incorporated by reference, teaches about an element being sound absorbing diffusor. Said diffusor device has the surface designed to face the sound source and includes a plurality of sound absorbing wells of equal widths but different depths separated by thin sound absorbing dividers. The depths of the individual wells are based upon the quadratic-residue number theory sequence which is used in acoustic design. The similarity with the present invention consist in that the cited solution uses wells of different depths that is similar with the cavities used in the present invention. However, the cited art remains silent regarding the movable planar diffusors and possible subsequent tune-up of the element.

Document U.S. Pat. No. 5,817,992; inventor is D'Antonio P., which is incorporated by reference, teaches about two-dimensional binary amplitude diffusor that is offering both absorption and modest diffusion. Cited invention consists of a flat-faced panel with a series of alternating reflective and absorptive regions or patches defined by a binary sequence consisting of zeros and ones with a flat power spectrum, such as the Maximum Length Sequence based upon shift register theory. Combining regions of absorption and reflection in the described manner results in an effective combination of absorption and diffusion. The similar binary amplitude diffusors are used in the present invention. However, the cited art remains silent about possible tuning properties, i.e. moving of the said diffusor over the cavities or wells.

Document U.S. Pat. No. 6,112,852; inventors are D'Antonio P. and Cox J. T., which is incorporated by reference, teaches about acoustical treatments with diffusive and absorptive properties. An appropriate binary sequence is used to create an acoustical treatment surface having desired parts with reflective properties and desired parts having absorptive properties resulting in the net effect of partially diffusive, partially absorptive properties. A genetic algorithm is designed to search for optimal 1D and 2D configurations for the acoustical treatments. However, the cited art remains silent about possible tuning properties. Namely, the cited invention is applicable in the form of amplitude reflection gratings formed over absorptive surface material.

The following document U.S. Pat. No. 7,520,370; inventor is Gudim W. O.; which is incorporated by reference, represents the closest prior art. The cited art teaches about the specific combination of acoustic diffusing and absorptive elements. The diffuser has an acoustically reflective surface with a plurality of wells, the depths of which wells may be determined by number theory sequences. In one embodiment, the absorber may include one or more tuneable Helmholtz resonators which may be attached to the rear face of the diffusing surface. So, the technical problem solved with the present invention is basically the same as with one solved in the cited art. However, the advantage of the present invention over cited prior art is simple and reliable tuning of the entire acoustic element without need to tune each Helmholtz resonator separately.

Other technical solutions exploited known theoretical background based in number theory sequences. Some examples are:

(i) document U.S. Pat. No. 8,424,637; inventor is Lenz R. L., which is incorporated by reference, teaches about systems and methods for providing an asymmetric cellular acoustic diffuser;

(ii) document U.S. Pat. No. 7,428,948; inventors are D'Antonio P. and Cox J. T., which is incorporated by reference, teaches about hybrid amplitude-phase grating diffusers; and (iii) document US 2005/0173187; Gardner J. W. and Colleran C. N., which is incorporated by reference, teaches about flat panel diffuser.

It is interesting to note that document US 2003/0006092; inventors D'Antonio P. and Cox J., incorporated by reference, teaches about sound diffuser with low frequency sound absorption basically having cuboid body which is equipped with the elongated wells. Having in mind that one of cited inventors in US 2003/0006092 is also inventor for the two dimensional binary amplitude diffusors disclosed in U.S. Pat. No. 5,817,992 renders present invention non-obvious. Namely, the present invention uses the combination of two movable planar binary amplitude diffusors that can overlap each other over a series of cavities, i.e. elongated wells, having different volumes and acting as a series of the Helmholtz resonators.

There are many other attempts to solve previously defined technical problems, such as: www.diffusor.com/English/Varitune/v4.htm Varitune® V-4 diffusor where the front shutter is used to adjust Helmholtz resonator in the range 45-110 Hz; however without binary amplitude diffusors. Another example is disclosed in US 2006/0042875 document, inventor Zainea I.-N., which is incorporated by reference, which teaches about wide band sound diffuser with self-regulated low frequency absorption and methods of mounting. To sum up, the present invention is new and non-trivial over the cited art having easy to tune-up properties.

SUMMARY OF INVENTION

An aspect of the present invention discloses a new resonator absorber with adjustable acoustic characteristics which has a plane bottom surrounded by sidewalls that are forming a cuboid with the open upper face. Interior is filled with other cuboids of different geometry which are fixed to the bottom of said resonator absorber. Two perforated plates are equipped with absorptive layers on their side facing said bottom. Said perforated plates are fixed to the guides formed in opposite sidewalls allowing the movement of said perforated plates in their respective planes parallel to the bottom. The perforated plates are situated at different heights from the bottom to allow upper perforated plate to slide over lower perforated plate when partially overlapping one another. The combined area of two perforated plates is capable to entirely cover cuboid open upper face.

Each perforated plate has rows of bores that are forming a planar binary amplitude diffusor. Said rows belonging to the different perforated plates are arranged in the manner that when perforated plates overlap—bores belonging to different perforated plates do not coincide in any position. This is necessary to prevent sound propagation through the overlapped region which serves as the reflective part of said resonator absorber.

Each perforated plate has mounted corresponding wing that extends towards the bottom and which is in contact with the corresponding cuboid situated at the bottom of the absorber. Each wing sliding over corresponding cuboids defines the volumes of the adjustable cavities, where two cavities are open and serve as sound reflective surfaces. Another two cavities covered by the corresponding perforated plates serve as absorptive and diffusive parts of said resonator absorber.

Lower perforated plate end and the corresponding stopper form another adjustable cavity that is always covered by the upper perforated plate. The volume of said cavity is defined by the position of the lower perforated plate and serves as absorptive and diffusive parts of said resonator absorber.

Disclosed resonator absorber has an additional cavity which has constant volume and is situated between two cuboids. Acoustic characteristics of the said cavity are changed solely by the overlapping region of the perforated plates above it. This cavity serves as the absorptive, diffusive and reflective parts of said resonator absorber. It is important to emphasize that independent movement of each perforated plate in their respective planes changes the acoustic properties of the said resonator absorber.

Bores forming a planar binary amplitude diffusor are arranged in one or more two dimensional patterns having dimensions N multiplied by M. Each of two dimensional pattern is obtained as a maximum length of the pseudorandom binary sequence of the order K mapped in the said matrix N×M by using Chinese remainder theorem in order to maximize the sound diffusion above the perforated plates. In the preferred embodiment maximum length pseudorandom binary sequence is selected to be K=10 and patterns with raster 33 by 31 are selected. Also, each perforated plate has two identical 2D patterns arranged mirror symmetrically over the longer plate side and upper perforated plate is mirror symmetrical to the lower perforated plate, when inserted into the resonator absorber. Each perforated plate has a perforation area that is less than 6%.

In another embodiments said cuboids of resonator absorber can be partially or completely filled with the sound absorption material. Each resonator absorber is characterized by the predefined resonant frequencies of adjustable cavities defined by the position of perforated plates when entirely covering upper cuboid open face. The disclosed resonator absorber with adjustable acoustic characteristics is used for tuning the acoustic characteristics of environment, alone, or in the form of array of two or more resonator absorbers simultaneously, each with arbitrary adjustable acoustic characteristics.

DETAILED DESCRIPTION

An aspect of the present invention discloses a resonator absorber with adjustable acoustic characteristics; that is a stand-alone self-supporting structure whose purpose is to tune the acoustic characteristics of environment. It can be used alone or as a part of array of two or more resonator absorbers simultaneously, each with arbitrary adjustable acoustic characteristics.

The preferred embodiment is depicted in FIGS. 1-6 which are used to explain the construction of the preferred embodiment of the invention and its use. The resonator absorber has a plane bottom (10) surrounded by sidewalls (11, 12, 13, 14) that are forming cuboid with the open upper face; see FIGS. 1A, 2A, and 3A. Preferably, the material used for manufacturing the bottom (10) and sidewalls (11, 12, 13, 14) are wooden material or wood-based composite material commonly used for said purpose, as known in the art. Other materials with similar acoustic properties can be equally used without restriction, as well as their combinations. Mutual connection of sidewalls (11, 12, 13, 14) and bottom (10) can be performed by any suitable technique, preferably by gluing the parts together positioned by pins; as already known in the furniture technology.

Figure 1A:
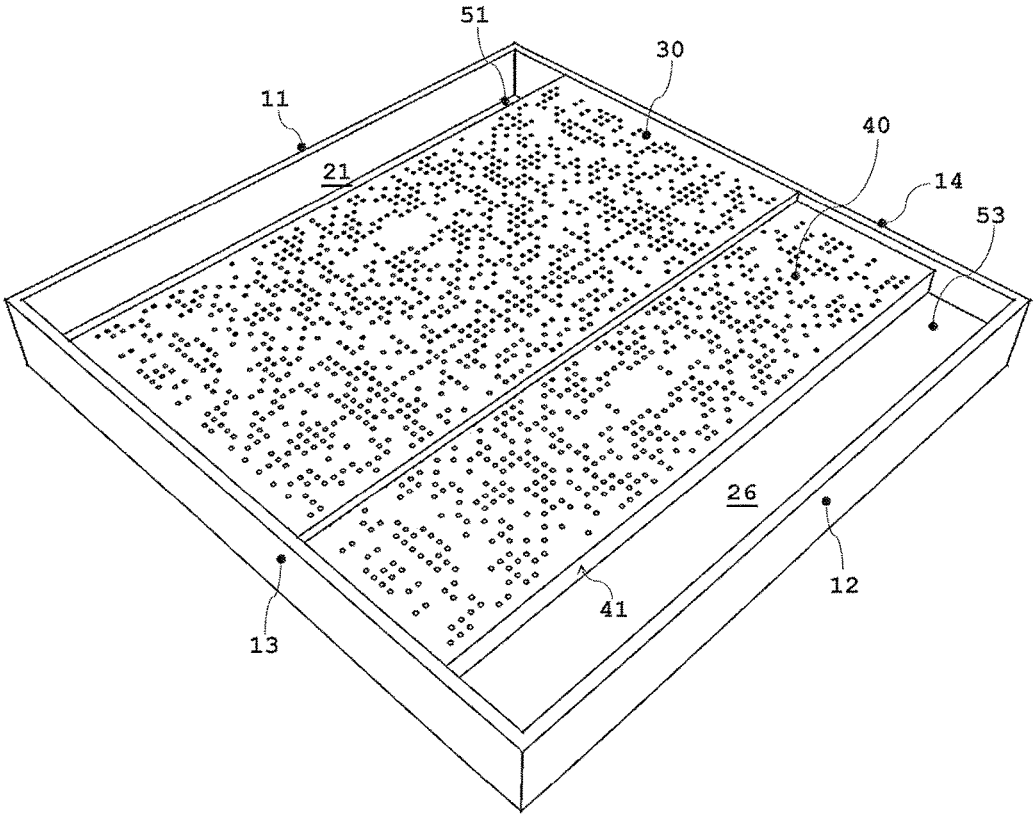
FIG. 1A shows the resonator absorber in isometric projection when perforated plates overlap partially.
Figure 1B:
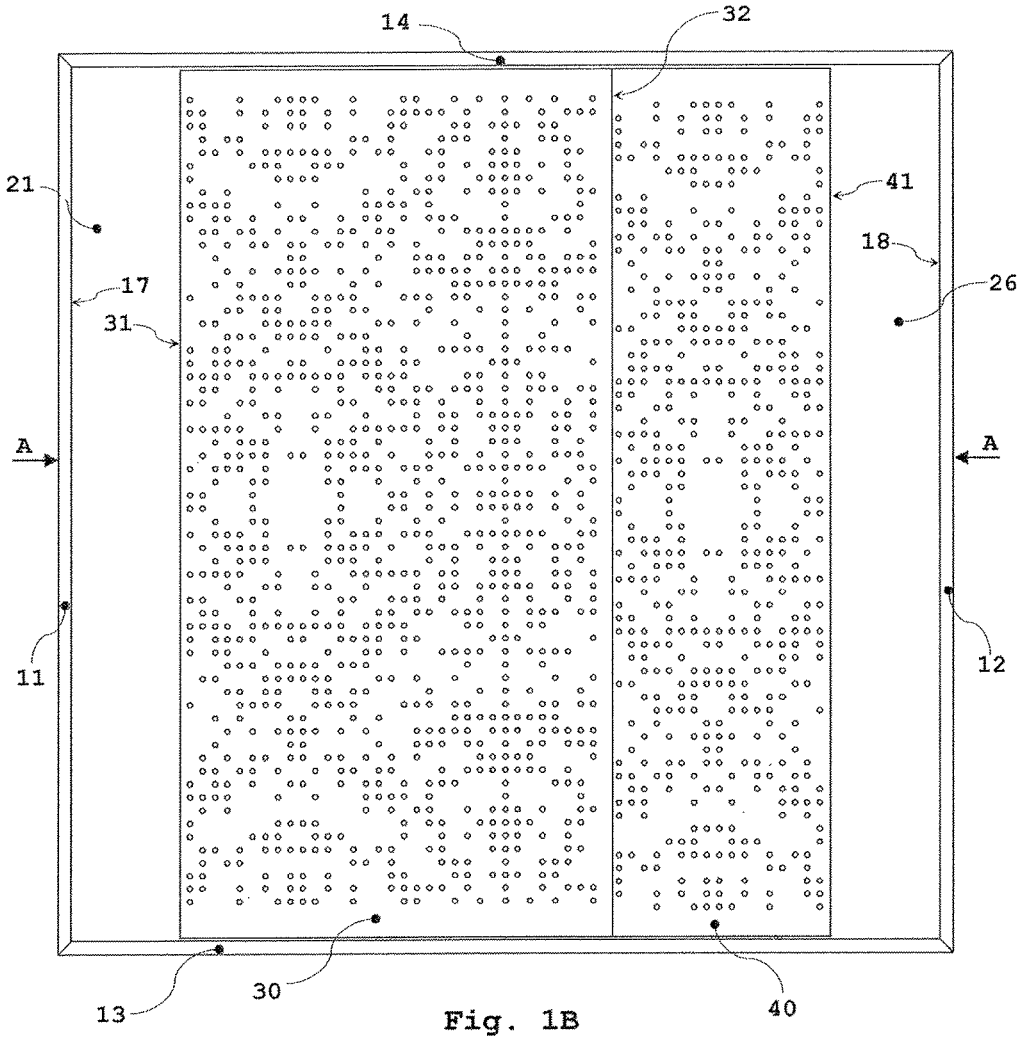
FIG. 1B shows the same situation from top view.
Figure 1C:
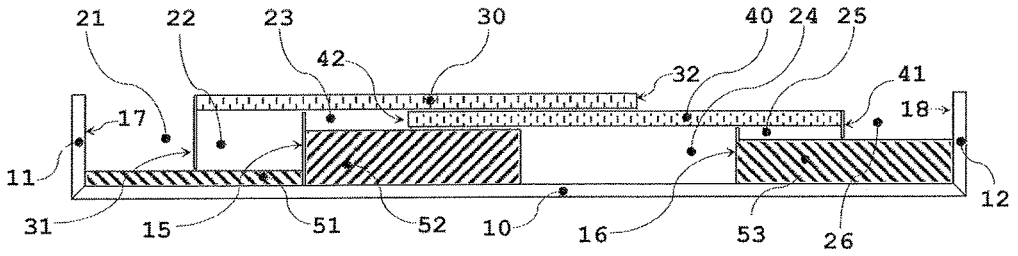
FIG. 1C represents the cross-section A-A of the situation depicted in FIG. 1A.
Figure 2A:
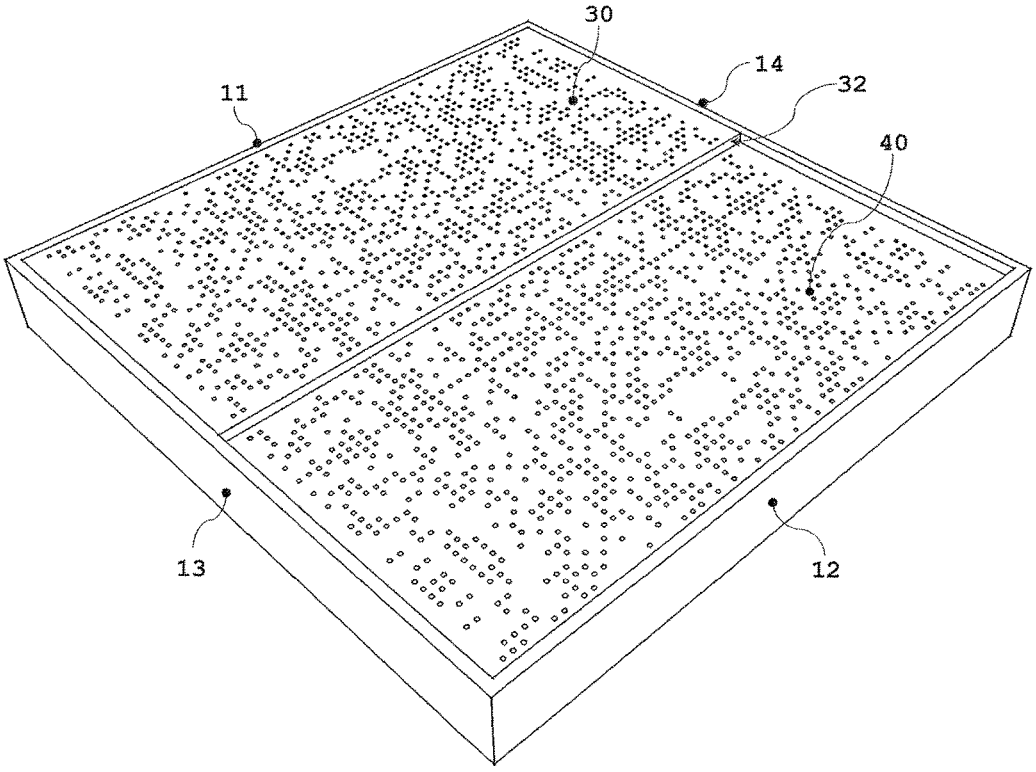
FIG. 2A shows the resonator absorber in isometric projection when perforated plates completely cover the upper cuboid open face of the said resonator absorber.
Figure 2B:
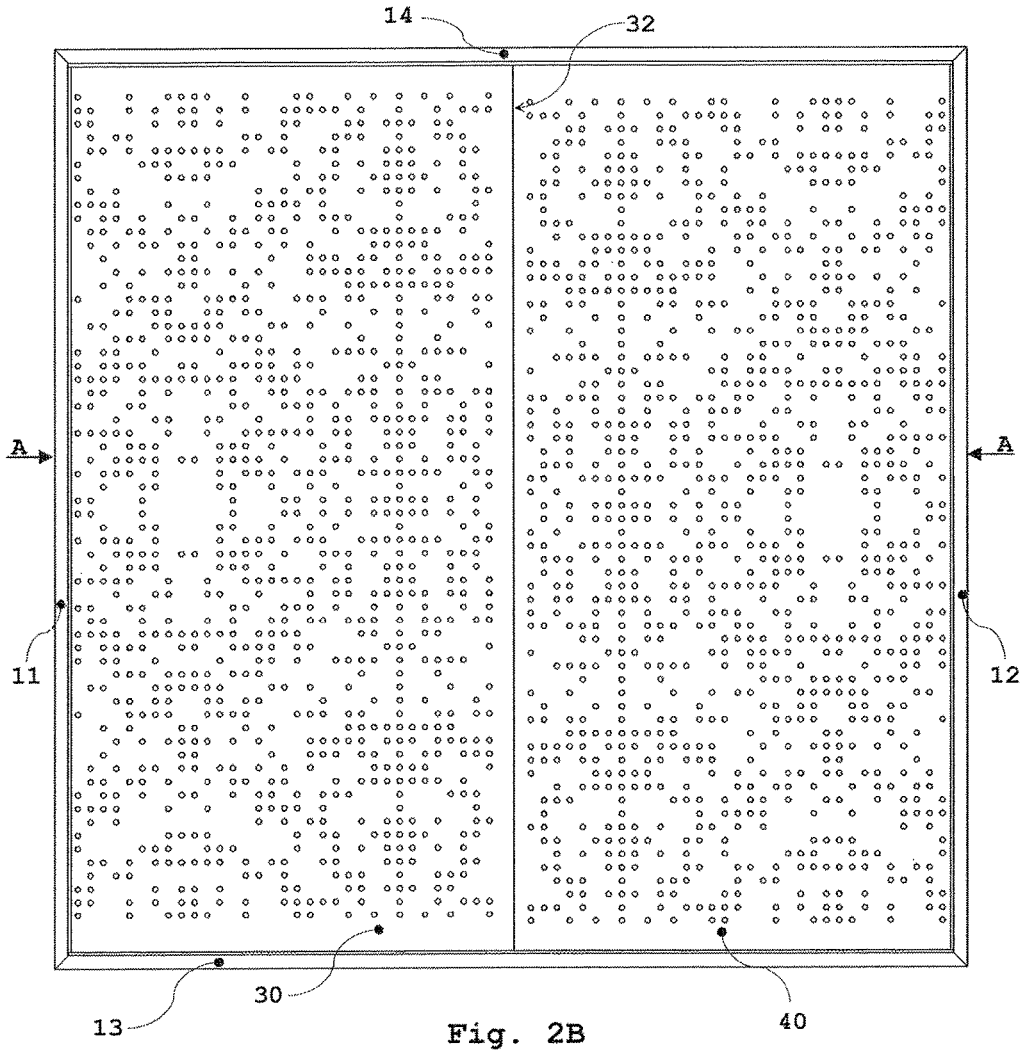
FIG. 2B shows the same situation from top view.
Figure 2C:
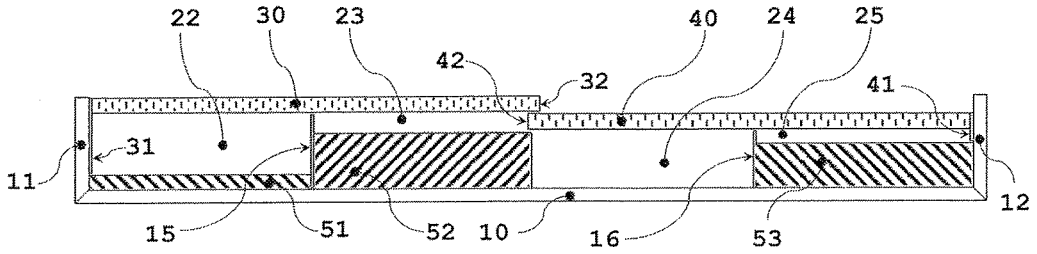
FIG. 2C represents the cross-section A-A of the situation depicted in FIG. 2A.
Figure 3A:
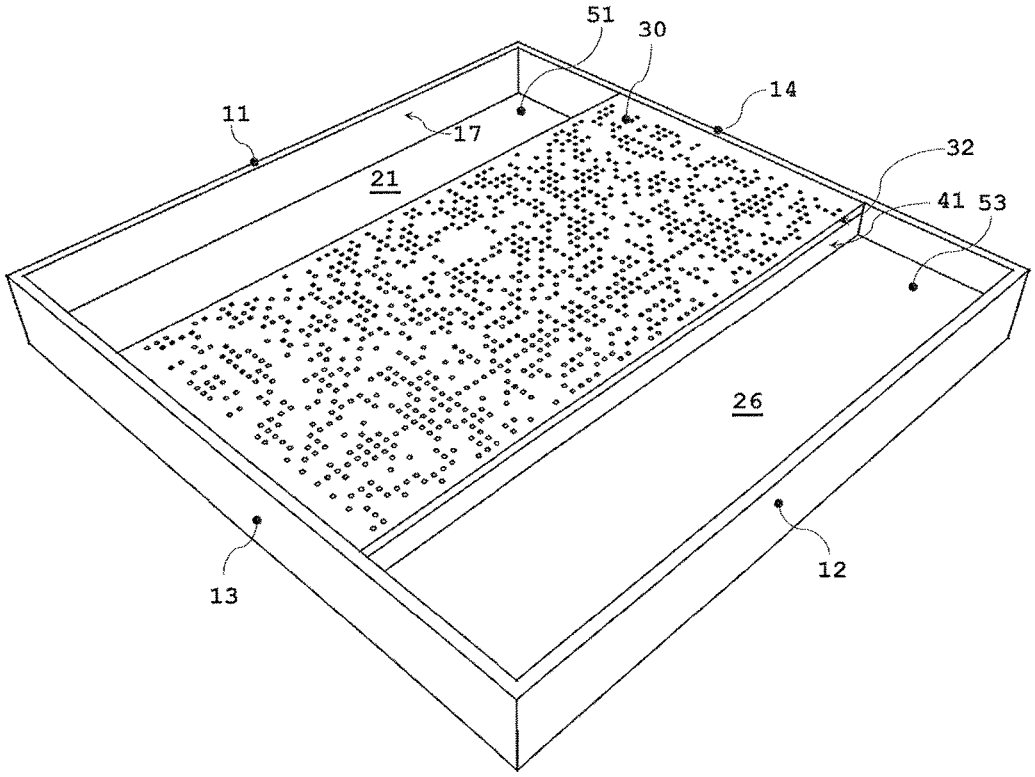
FIG. 3A shows the resonator absorber in isometric projection when perforated plates overlap each other completely.
Figure 3B:
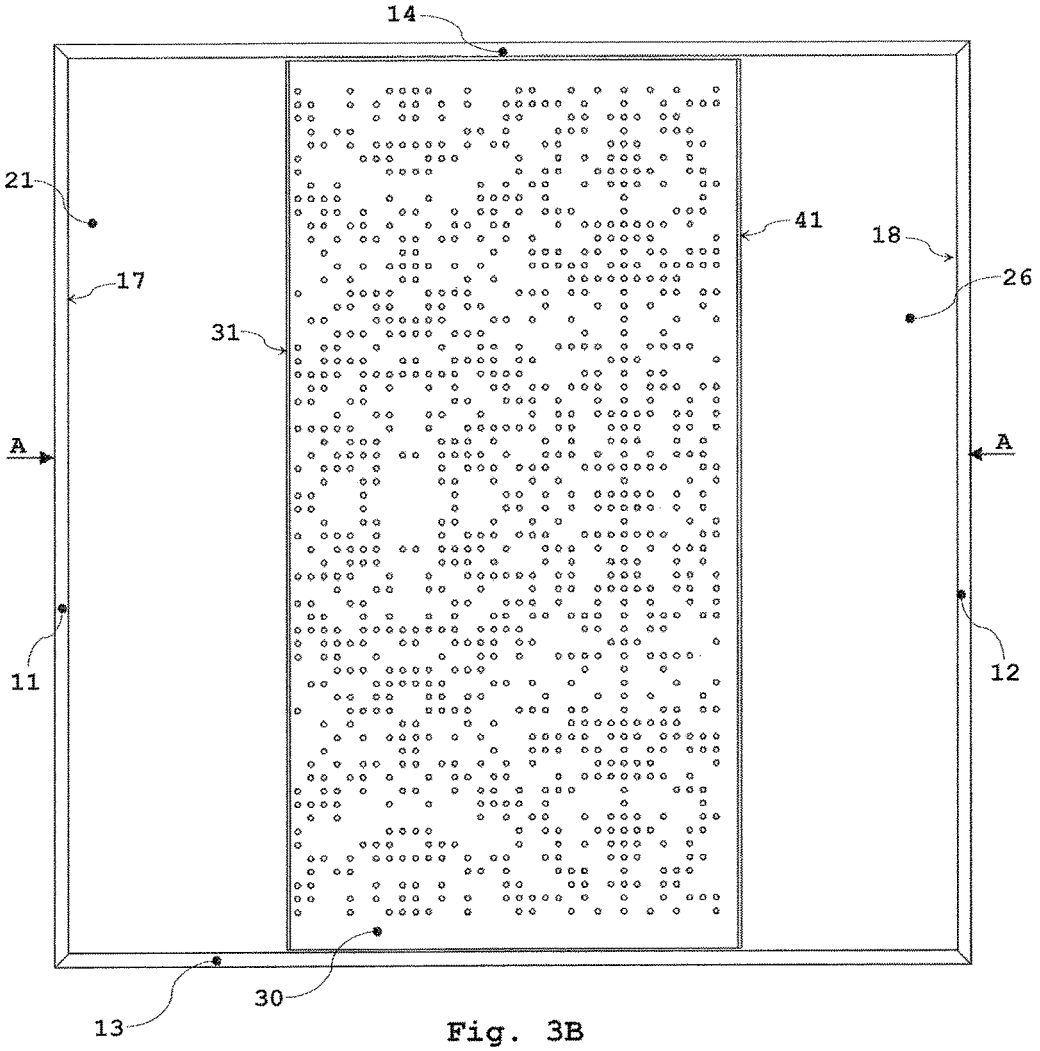
FIG. 3B shows the same situation from top view.
Figure 3C:
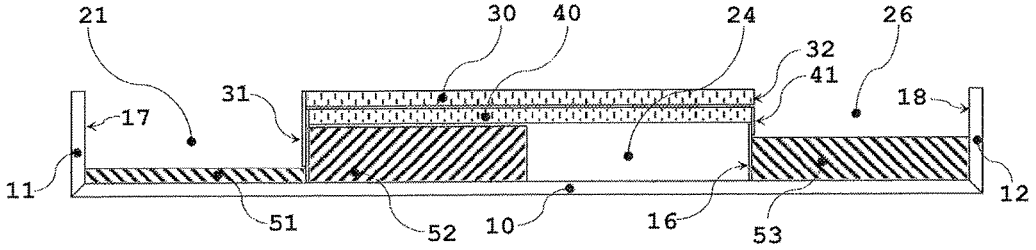
FIG. 3C represents the cross-section A-A of the situation depicted in FIG. 3A.

The interior of said formed cuboid is filled with other cuboids (51, 52, 53) as depicted in FIGS. 1C, 2C and 3C. Mentioned cuboids (51, 52, 53) have different geometry and are fixed to the bottom (10) of said resonator absorber by any suitable technique, preferably by gluing or screwing the parts. In practice, the desired technical effect is to obtain four different plains situated above the bottom (10) at different heights, as depicted in FIG. 1C. The first plane is cuboid (51) with face oriented up, the 2nd plane is cuboid (52) with face oriented up, the 3rd plane is part of the bottom (10) oriented up and situated between the cuboid (52) and the cuboid (53), and 4th plane is cuboid (53) with face oriented up. Said cuboids (51, 52, 53) can be solid, hollow or partially filled with the sound absorption material. Preferably, cuboids (51, 52, 53) are manufactured from wooden material or wood-based composite material commonly used in the art. If filled, the standard fillers known in the art are used which are capable to absorb mechanical sound energy. Upper cuboid (51, 52, 53) faces are machined and finished to form reflective surfaces, as well as the part of the bottom (10) used as 3rd plane.

Two perforated plates, i.e. upper perforated plate (30) and lower perforated plate (40), which we will describe later in more detail, are fixed to the guides formed in opposite sidewalls (13, 14). Guides should provide smooth movements of the said perforated plates (30, 40) one over another. Any suitable guides are equally well applicable. The essence is that said guides allow the movement of said perforated plates (30, 40) in their respective planes parallel to the bottom; FIGS. 1C, 2C and 3C. The perforated plates (30, 40) are situated at different heights from the bottom (10). Purpose of that is to allow upper perforated plate (30) to slide over lower perforated plate (40), practically without air gap, when upper perforated plate (30) overlaps lower perforated plate (40). The combined area of two perforated plates (30, 40) is capable to entirely cover cuboid open upper face as depicted in FIG. 2B.

Figure 4A:
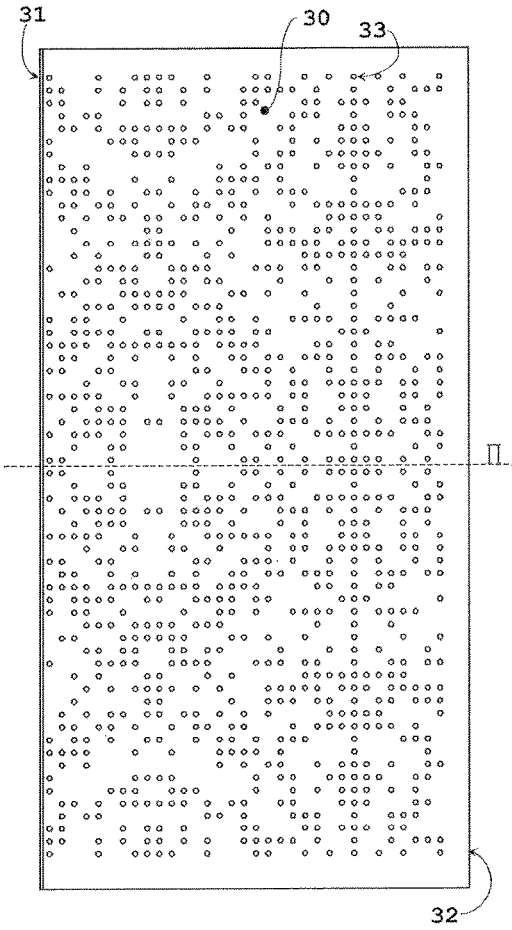
FIG. 4A represent the upper perforated plate equipped with the bores forming planar binary diffusor.
Figure 5A:
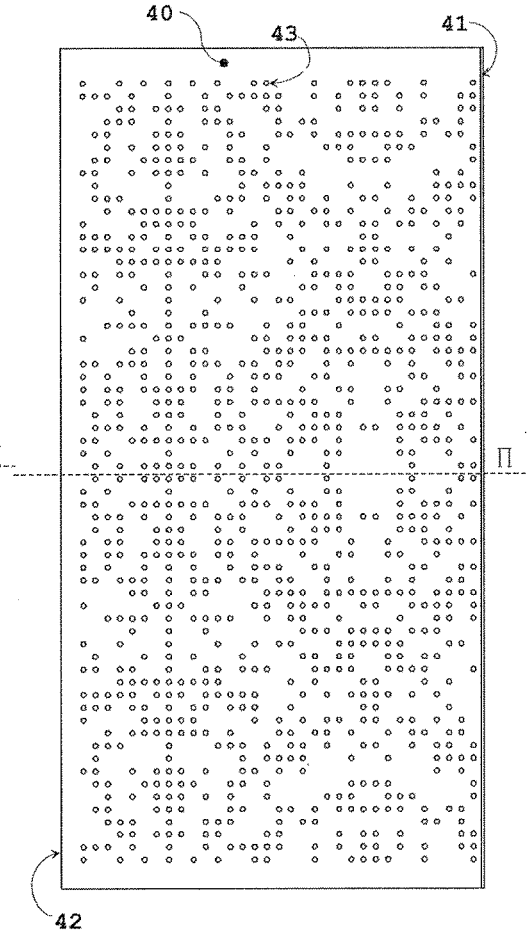
FIG. 5A represents the lower perforated plate equipped with the bores forming planar binary diffusor.
Figure 6:
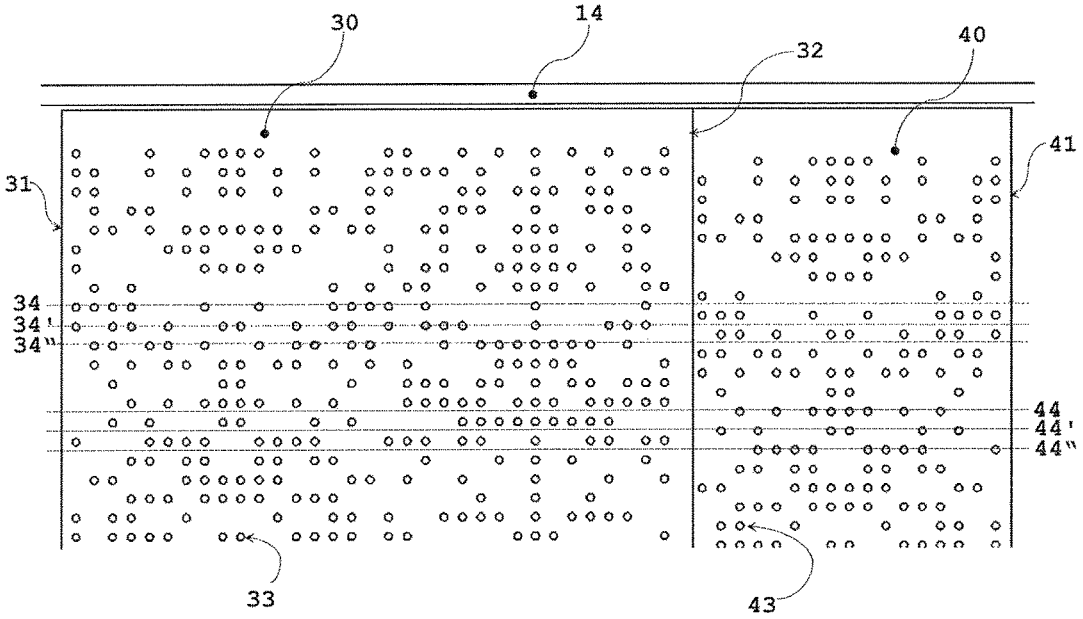
FIG. 6 represents mutual position of the rows belonging to the upper and lower perforated plates.

Few words should be said about the perforated plates (30, 40) construction. The technical roles of said perforated plates (30, 40) are to act as the planar binary amplitude diffusors in the manner already described in the prior art and as the upper perforated plate of the resonator absorber. Perforated plates (30, 40) are preferably manufactured from wooden material or wood-based composite material commonly used in the art. Each perforate plate (30, 40) has their respective set of rows (34, 44) of bores (33, 43) drilled in said plates (30, 40); FIGS. 4A, 5A. The rows (34, 34', 34", . . . , 44, 44', 44", . . . ) belonging to the different perforated plates (30, 40) are arranged in the manner where perforated plates (30, 40) overlap—bores (33, 43) belonging to different perforated plates (30, 40) do not coincide in any position, once perforated plates (30, 40) are being inserted into their guides; FIG. 6. This technical feature is necessary for proper functioning of the present invention. Namely, the role is to prevent sound propagation through the overlapped region of the perforated plates (30, 40) that serves as the reflective part of said resonator absorber.

Figure 4B:
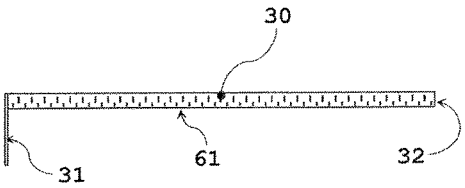
FIG. 4B represents side view of the same perforated plate.
Figure 5B:
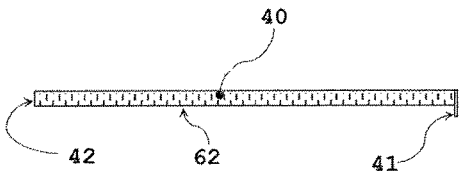
FIG. 5B represents the side view of the same perforated plate.

Each perforated plate (30, 40) has on one of its end a corresponding wing (31, 41) that extends towards the bottom (10); FIGS. 4B, 5B. Each perforated plate (30, 40) is equipped with absorptive layers (61, 62) on their side facing said bottom (10), forming an integral structure. Whenever perforated plates (30, 40) are mentioned, it should be understood that the perforated plates (30, 40) are covered with absorptive layers (61, 62). The technical role of mentioned absorptive layers (61, 62) is decreasing the sound energy of the sound waves hitting the perforated plate (30, 40). Absorptive layers (61, 62) cover entire bottom surface of perforated plate (30, 40), covering also the bores (33, 43). The type of material and the thickness of the absorptive layers (61, 62) should be carefully selected in a manner that the resonator absorber matches the acoustic impedance of air. This fact is very well known in related art. On the opposite side, each perforate plate (30, 40) has a standard plate end (32, 42). Upper perforated plate (30) can freely move from the position depicted in FIG. 2C where the wing (31) is in the contact with the stopping surface (17) of the sidewall (11) to the position depicted on the FIG. 3C where the wing (31) is stopped by the stopper (15) situated between the cuboids (51, 52). Lower perforated plate (40) can move freely from the position depicted in FIG. 2C where the wing (41) is in the contact with the stopping surface (18) of the sidewall (12) to the position depicted in FIG. 3C where the plate end (42) is stopped by the stopper (15) situated between the cuboids (51, 52), and the wing (41) is stopped by the stopper (16) situated on the cuboid (53).

Each wing (31, 41) is in permanent contact with the corresponding cuboids (51, 53) across its entire length, i.e. from the sidewall (13) to the sidewall (14). The essential technical feature that is expected is that each wing (31, 41) is capable of sliding over corresponding cuboids (51, 53) in any moment. Wings (31, 41) sliding over said cuboids (51, 53) define the volumes of the adjustable cavities (21, 22, 25, 26); FIG. 1C. Cavities (21, 26) are, when exist, open and serve as sound reflective surfaces of the exchangeable geometry; FIGS. 1C and 3C.

Cavities (22, 25) are covered by the corresponding perforated plates (30, 40) from the above and have the volume defined by the position of inner part of the wing (31, 41) against the wing stoppers (15, 16) and upper face positions of the corresponding cuboids (51, 53). Such cavities (22, 25) serve as absorptive and diffusive parts of said resonator absorber and have the cuboid shape. From the engineering point of view, mentioned cavities (22, 25) without air-gap on the contact surfaces, i.e. stopper (15, 16)—perforated plate (30, 40) and wing (31, 41)—cuboid (51, 53); are important for the reliable functioning of the said resonator absorber.

The wings (31, 41) can be manufactured from wooden material or wood-based composite material commonly used in the art, and preferably glued or otherwise attached to their respective perforate plates (30, 40). It is worth to note that the wings (31, 41) are of different size that strongly depends of the used cuboids (51, 53) geometry. Upper contact surface of lower perforated plate (40) should be additionally polished and varnished. This feature will ensure that the absorptive layer (61) of upper perforated plate (30) will glide smoothly over perforated plate (40) without air-gaps.

It is obvious that perforated plate (30, 40) movements adjust the volume of the cavities (21, 26) from zero to some maximum volume obtained when the perforated plates (30, 40) are pushed to the center of the resonator absorber. The opposite is valid for the cavities (22, 25) whose volumes are maximal when the perforated plates (30, 40) are maximally separated.

Perforated plate (30, 40) movement also defines the properties of other cavity (23). Perforated plate end (42) and the corresponding stopper (15) form another adjustable cavity (23) that is always covered by the plate (30). The volume of said cavity (23) is only defined by the position of the perforated plate (40), (i.e. wing (41)), relative to the sidewall (12) and serves as absorptive and diffusive parts of said resonator absorber.

The disclosed resonator absorber has an additional cavity (24) that has constant volume, situated between two cuboids (52, 53). Its acoustic characteristics are changed solely by the overlapping of the said perforated plates (30, 40) above the said cavity (24). That part of the disclosed resonator absorber serves as absorptive, diffusive and reflective parts.

It is obvious that independent movement of each perforated plate (30, 40) in their respective planes significantly change the acoustic properties of the said resonator absorber which is clearly visible from the FIGS. 1C-3C and 1B-3B.

Few words should be addressed towards the perforated plates (30, 40) used as the planar binary diffusors, already disclosed via the prior art, and depicted via FIGS. 4A, 5A. The corresponding bores (33, 43) are distributed to form one or more 2D patterns, i.e. matrix, having dimension N×M. Each of said two dimensional pattern is obtained as a maximum length of the pseudorandom binary sequence of the order K mapped in the said matrix N×M by using Chinese remainder theorem in order to maximize the sound diffusion above the perforated plates (30, 40), as already known in the art, e.g. J. A. S. Angus and P. D'Antonio, "Two dimensional binary amplitude diffusers", Proc. Audio Eng. Soc., preprint 5061 (D-5) (1999), which is incorporated by reference.

Experimental setups via wooden models and additional simulations calculated via Matlab® packages empirically confirmed that the preferred design and characteristic are achieved when the maximum length pseudorandom binary sequence is selected to be K=10, and where the used raster, i.e. matrix, with 33×31 are selected. The mentioned raster was chosen in order to give a raster with the most similar lengths of dimensions, e.g. if the length of pseudorandom binary sequence would be K=8, the raster would have to be 7×73, which doesn't meet the requirements for a part of element with square or almost square shape.

Moreover, the calculation revealed another preferred design where each perforated plate (30, 40) has two identical 2D patterns arranged mirror symmetrically over the longer plate side; i.e. over the plane II depicted in FIGS. 4A, 5A. Finally, the preferred design has the upper perforated plate (30) that is mirror symmetrical to the lower perforated plate (40), when both inserted into the resonator absorber; as depicted in FIG. 2B.

Third party surveys performed by Vican I., Jambrošić K., Horvat M., "Comparison of acoustic resistance of a perforated plate absorber with a tightly and loosely placed thin porous layer", 6th Congress of Alps-Adria Acoustics Association, (2014), which is incorporated by reference; U. Ingard, "On the theory and design of acoustic resonators", Journal of the Acoustical Society of America 25 1037-1061, (1953), which is incorporated by reference, indicate that the decrease of the porosity of the perforated plate can significantly improve the acoustic resistance, and thus the overall acoustic characteristics. The target value of porosities, just below 6%, is chosen in accordance to match the acoustic impedance of air.

Once the resonator absorber with adjustable acoustic characteristics is manufactured according to the preferred embodiment, its characteristic can be simply labeled with the following parameters:

(i) planar binary diffusors type used, and (ii) with the resonant frequencies corresponding to the cavities (22, 23, 24, 25) once perforated plates (30, 40) being in position to cover upper cuboid open face.

For the environments having less than 100 cubic meters, probably one or two resonator absorber; each having 0.2-1 cubic meters volume, with resonant frequencies corresponding to the cavities (22, 23, 24, 25) tuned to different spectra are more than sufficient to improve the sound quality reception and eliminate unwanted effects. It is emphasized several times that disclosed resonator absorber can change/tune acoustic properties in a simple and reliable manner. Effectively it means that resonator absorbers, once positioned, can be "in situ" manually adjusted with or without the help of additional measuring sound processing equipment. Moreover, the mutual perforated plates (30, 40) positions within the resonator absorber sidewalls can be simply "memorized" by outer marks made on the sidewalls (13, 14). That fact enables the disclosed invention to be quickly used for different environments once calibration is performed and position within the environment defined. That feature is not rendered obvious for the technical solutions found in the prior art.

For larger environments like churches, conference halls, half-open spaces it is natural to use whole arrays of resonator absorbers simultaneously, each with arbitrary adjustable acoustic characteristics.

INDUSTRIAL APPLICABILITY

The present invention discloses resonator absorber with adjustable acoustic characteristics. Disclosed resonator absorber, formed as a standalone element, is useful for tuning the acoustic characteristics of environment with mechanically adjustable reflective, diffusive and absorptive parts. Therefore, the industrial applicability of the said invention is obvious.

REFERENCES

10—bottom
11, 12, 13, 14—sidewalls
15, 16—stoppers
17, 18—stopping surfaces
21, 22, 23, 24, 25, 26—cavities
30, 40—perforated plates
31, 41—wings
32, 42—plate ends
33, 43—bore
34, 44—rows of bores
51, 52, 53—cuboids
61, 62—absorptive layers

The invention claimed is:

1. A resonator absorber with adjustable acoustic characteristic comprising:

a plane bottom surrounded by sidewalls forming a cuboid with an open upper face filled with cuboids of different geometry fixed to the bottom;

two perforated plates entirely covered with absorptive layers on their side facing said bottom, where said perforated plates are fixed to the guides formed in opposite sidewalls allowing the movement of said perforated plates in their respective planes parallel to the bottom, where said planes are at different heights from the bottom to allow an upper perforated plate of the two perforated plates to slide over a lower perforated plate of the two perforated plates, partially overlapping one another; and where the combined area of two perforated plates is capable to entirely cover the cuboid open upper face;

wherein each perforated plate has rows of bores forming a planar binary amplitude diffusor; where said rows belonging to the different perforated plates are arranged in the manner where perforated plates overlap, the bores belonging to the different perforated plates do not coincide in any position in order to prevent sound propagation through the overlapped region that serves as a reflective part of said resonator absorber;

each perforated plate has mounted a corresponding wing that extends towards the bottom being in contact with the corresponding cuboids situated at the bottom; each wing sliding over the corresponding cuboids defines the volumes of the adjustable cavities, where a first portion of the cavities are open and serve as sound reflective surfaces, and where a second portion of the cavities covered by the corresponding perforated plates serve as absorptive and diffusive parts of said resonator absorber;

a perforated plate end and a corresponding stopper form another adjustable cavity always covered by a first one of the perforated plates, where a volume of said cavity is defined by the position of the second one of the perforated plates and serve as absorptive and diffusive parts of said resonator absorber;

where said resonator absorber has an additional cavity of constant volume, situated between the cuboids, which acoustic characteristics are changed by the overlapping of the said perforated plates above the said cavity, where the additional cavity serves as absorptive, diffusive and reflective parts of said resonator absorber; and where independent movement of each perforated plate in their respective planes change the acoustic properties of said resonator absorber.

2. The resonator absorber with adjustable acoustic characteristics according to the claim 1, wherein the bores forming a planar binary amplitude diffusors arranged in one or more two dimensional patterns having dimension N×M, each two dimensional pattern is obtained as a maximum length of a pseudorandom binary sequence of the order K mapped in the said matrix N×M by using Chinese remainder theorem in order to maximize the sound diffusion above the perforated plates.

3. The resonator absorber with adjustable acoustic characteristics according to the claim 2, wherein the maximum length pseudorandom binary sequence is selected to be K=10.

4. The resonator absorber with adjustable acoustic characteristics according to the claim 3, wherein 2D patterns with raster 33×31 are selected.

5. The resonator absorber with adjustable acoustic characteristics according to the claim 4, wherein each perforated plate has two identical 2D patterns arranged mirror symmetrically over the longer plate side; the first perforated plate is mirror symmetrical to the second perforated plate when inserted into the resonator absorber.

6. The resonator absorber with adjustable acoustic characteristics according to the claim 5, wherein each perforated plate has a perforation area less than 6%.

7. The resonator absorber with adjustable acoustic characteristics according to claim 1, wherein the cuboids are further partially or completely filled with sound absorption material.

8. The resonator absorber with adjustable acoustic characteristics according to claim 1, wherein once the perforated plates are in a position to cover the upper cuboid open face, the resulting cavities are tuned to predefined resonant frequencies.

9. The resonator absorber with adjustable acoustic characteristics according to claim 1 used for tuning the acoustic characteristics of the environment.

10. Use of two or more resonator absorbers simultaneously, each with arbitrary adjustable acoustic characteristics according to claim 1, for tuning the acoustic characteristics of the environment.

* * * * *